United States Patent [19]

Alonso et al.

[11] Patent Number: 4,542,948

[45] Date of Patent: Sep. 24, 1985

[54] HOUSING FOR A FEMALE ELECTRICAL CONTACT

[75] Inventors: Martin Alonso; Francisco Villazon, both of Barcelona, Spain

[73] Assignee: AMP Incorporated, Harrisburg, Pa.

[21] Appl. No.: 550,663

[22] Filed: Nov. 10, 1983

[30] Foreign Application Priority Data

Dec. 7, 1982 [ES] Spain ..... 269031[U]

[51] Int. Cl.[4] ..... H01R 11/00

[52] U.S. Cl. ..... 339/59 R; 339/61 R; 339/217 S; 339/256 S

[58] Field of Search ..... 339/59 R, 217 S, 65, 339/61 R, 61 C, 74 R, 256 SP, 258 S

[56] References Cited

U.S. PATENT DOCUMENTS

| | | | |
|---|---|---|---|
| 3,753,193 | 8/1973 | Teagno et al. | 339/65 |
| 3,825,880 | 7/1974 | Battaglia et al. | 339/59 R |
| 3,990,759 | 11/1976 | Crowe | 339/59 R |
| 4,046,450 | 9/1977 | Yurtin | 339/217 S |

FOREIGN PATENT DOCUMENTS

| | | |
|---|---|---|
| 0035861 | 9/1981 | European Pat. Off. . |
| 2445633 | 12/1978 | France . |

*Primary Examiner*—Gil Weidenfeld
*Assistant Examiner*—Paula Austin
*Attorney, Agent, or Firm*—Jay L. Seitchik

[57] ABSTRACT

A moulded insulating housing for a female electrical contact has an internal latching boss for engagement with detent means on the female contact. The latching boss, which is shaped as a right angle triangle, as seen in plan view, has a first ramp tapering towards one end of the housing and a latching shoulder facing the opposite end of the housing. A second ramp formed integrally with a lower wall of the housing opposite to the first ramp is directed towards the one end of the housing. The latching boss, has a flat summit which is also shaped as a right angle triangle as seen in plan view, the first ramp and the latching shoulder immediately adjoining the flat summit.

3 Claims, 8 Drawing Figures

FIG. 1.
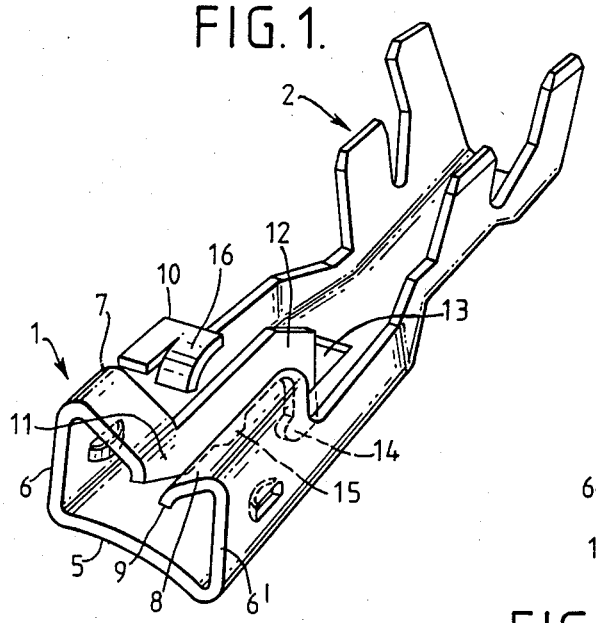
FIG. 1A.
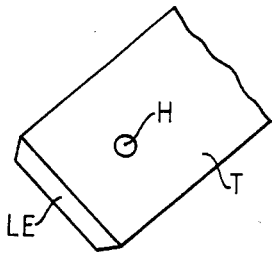
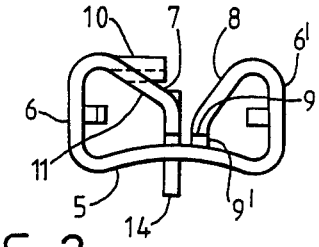
FIG. 2.
FIG. 3.
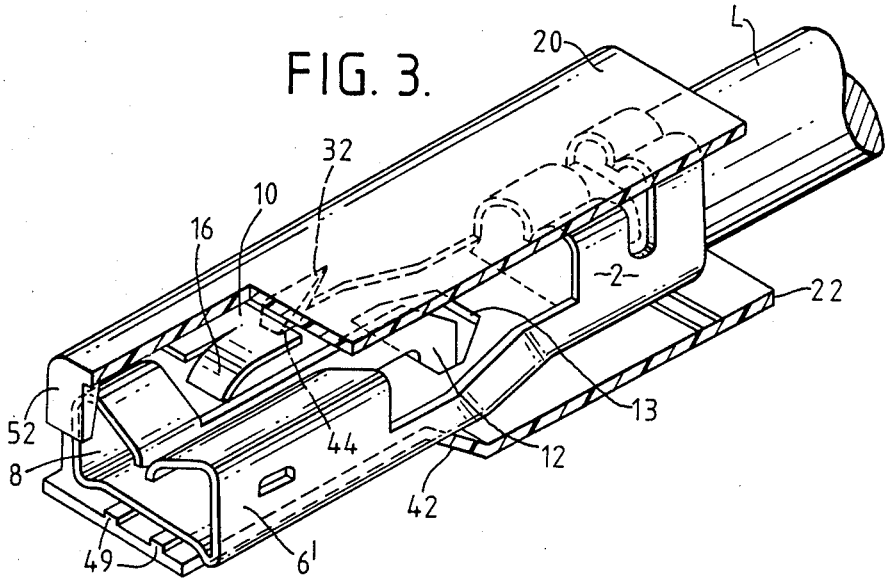

HOUSING FOR A FEMALE ELECTRICAL CONTACT

FIELD OF THE INVENTION

This invention relates to a moulded, one-piece, open ended tubular insulating housing of the type for receiving in latching engagement, a female electrical contact for mating with a flat electrical tab.

DESCRIPTION OF THE PRIOR ART

There is known from French patent application No. 78.36861 (Publication No. 2,445,633), a moulded, one-piece, open ended tubular insulating housing of substantially rectangular cross-section, for a female electrical contact, the housing comprising upper and lower walls connected by first and second side walls, and having a first, contact insertion end and a second, electrical tab insertion end, a latching boss formed integrally with the inner surface of the upper wall at a position spaced from the second end of the housing but being nearer to the second end of the housing than to the first end thereof, providing a first ramp tapering towards the first end of the housing and a latching shoulder facing the second end of the housing, a second ramp formed integrally with the lower wall of the housing opposite to the first ramp being directed towards the first end of the housing, the latching boss being shaped as a right angle triangle, as seen in plan view, and being nearer to the first side wall than to the second side wall.

There is also known from European Patent Specification No. 0035861, a female electrical contact comprising a receptacle portion for receiving a flat electrical tab and a wire lead connecting portion, the receptacle portion comprising a base and first and second side plates upstanding from opposite sides of the base, the side plates having respective first and second extensions projecting from their edges remote from the base, inwardly towards the base, to provide in cooperation therewith, a socket into which the tab can be inserted, the first extension having a tab retention spur and terminating in a tongue projecting through a hole in the base, a detent support projecting from the edge of first side plate, remote from the base, between the first extension and the connecting portion, bearing a cantilever detent projecting obliquely towards the first extension at a position nearer to the first side plate than to the second.

SUMMARY OF THE INVENTION

The present invention is directed to the achievement of improved retention of the contact in the housing. Means are also disclosed for facilitating the insertion of the tab into the female connector.

It is accordingly an object of the invention to provide an improved housing for receiving a female contact, in which the latching boss of the housing is formed for better retention of the female contact. It is another object of the invention to provide means on the housing for facilitating the insertion of the tab into the female contact. It is yet a further object of the invention to provide an improved combination comprising a moulded, one-piece, open ended tubular insulating housing and a female electrical contact for receiving an electrical tab.

The latching boss has a flat summit which is also shaped as a right angle triangle, as seen in plan view, and which is parallel to the upper wall of the housing, the first ramp and the latching shoulder immediately adjoining the flat summit.

The locking boss of the housing is especially adapted to cooperate with the cantilever detent of the contact in the housing with a snap action as the contact is inserted thereinto, without fouling the contact during its insertion. It has been found that the flat summit of the latching boss has the advantage that the retention of the contact in the housing, against an axial pulling force exerted on the lead, is improved as compared with the case where the latching boss is of pyramidal shape and of the same height, without the force needed to insert the contact into the housing being increased. The lower wall of the housing can be formed with a pair of parallel guide ribs for the receptacle portion of the contact. It has been found that the insertion of the tab into receptacle portion is facilitated if the ribs are made to extend up to the second end of the housing, especially where the leading end of the tab is burred.

These and other objects of the invention are achieved by the preferred embodiment of the invention which is described in detail below.

DESCRIPTION OF THE DRAWINGS

FIG. 1 is a perspective view of an example of a female electrical contact;

FIG. 1A is a plan view of the leading end portion of an electrical tab for mating with the female contact;

FIG. 2 is an end view of a receptacle portion of the contact;

FIG. 3 is a perspective view with parts removed, of an insulating housing according to the invention receiving the contact which has been crimped to an electrical lead;

Figure 4:
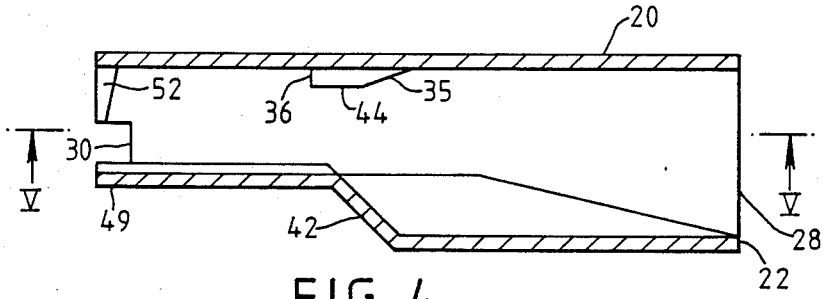
FIG. 4 is a longitudinal vertical sectional view through the housing.

The contact, which is for mating with a flat electrical tab T (FIG. 1A), comprises a receptacle portion 1 and a wire connecting portion 2 in the form of a U-cross section ferrule for crimping about an electrical lead as shown in FIG. 3.

The portion 1 comprises a base 5 and first and second side plates 6 and 6', respectively, upstanding from opposite sides thereof, the plates 6 and 6' having respective first and second extensions 7 and 8, projecting from their edges remote from the base 5, towards the base 5, to provide in cooperation therewith a socket in which the tab can be gripped between the base 5 and a free edge 9 of the extension 8. A tab stop 9' (FIG. 2) projects from that end of the edge 9 which is nearest to the portion 2, towards the base 5. The extension 7 has a shank portion 11 provided with a tab retention spur 15, and terminates in a tongue 12 the free extremity 14 of which protrudes through a hole 13 in the base 5 as shown in FIG. 2. A detent support 10 projecting from the edge of the plate 6 remote from the base 5, between the extension 7 and the wire connecting portion 2, bears a cantilever detent 16 directed obliquely towards the extension 7, at a position nearer to the side plate 6 than to the side plate 6'. When the tab T is gripped between the edge 9 and base 5, the spur 15 engages in a central hole H in the tab T thereby preventing its withdrawal from the receptacle portion 1. In order to allow the tab to be withdrawn, the extremity 14 of the tongue 12 can be pressed up towards the base 5, whereby the spur 15 is removed from the hole H in the tab T.

The housing which has been moulded in one piece from an insulating plastics material and which is in the form of an open ended tube of substantially rectangular cross-section, comprises an upper wall 20 and a lower wall 22, connected by first and second side walls 24 and 26, respectively. The housing has a first, contact insertion end 28 through which the female contact can be inserted with its receptacle portion 1 leading, and a second, tab insertion end 30 through which the leading end LE of the tab T can be inserted to mate with the receptacle portion 1 of the contact. A latching boss 32 shaped as a right angle triangle, as seen in plan view in FIG. 5, and being formed integrally with the inner surface of the wall 20 at a position spaced from the end 30, but being nearer to the end 30 than to the end 28, has a first side 34 providing a first ramp 35 tapering towards the end 28 of the housing, a second side 36 perpendicular to the wall 20 and constituting a latching shoulder facing the end 28, and a third side 38 facing, and parallel to, the side wall 24. A second ramp 42 formed integrally with the wall 22, opposite to the ramp 35, is directed towards the end 28 of the housing.

Figure 5:
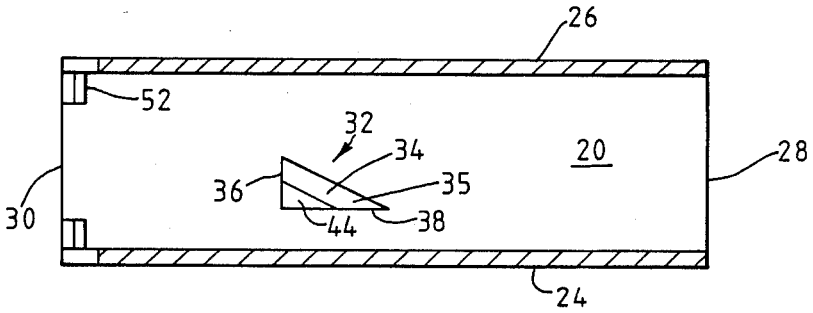
FIG. 5 is a sectional view taken on the lines V—V of FIG. 4.
Figure 6:
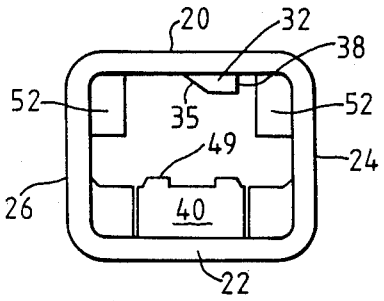
FIGS. 6 and 7 are respective end views of the housing.
Figure 7:
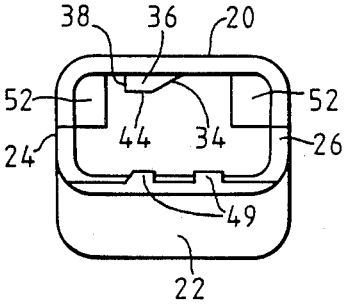

The boss 32, which is nearer to the side 24 than to the side 26, so as to be engageable by the detent 16 of the contact during its insertion into the housing, has a fourth side 44 which is also in the form of a right angle triangle, as seen in plan view in FIG. 5, and which is parallel to the wall 20, the sides 34, 36 and 38 of the boss 32 all being adjacent to the side 44 which forms a flat summit of the boss 32. The side 34 projects beyond the side 44 towards the end 28 of the housing.

At the end 30 of the housing are a pair of stops 52. The wall is formed with a pair of parallel guide ribs 49 extending longitudinally of the housing, up to the end 30 thereof.

As the contact is being inserted into the housing, the detent 16 is depressed by the ramp 35 of the boss 32 so that the detent carrier 10 is bent resiliently down about its junction with the side plate 6, the detent 16 then being guided by the ramp 35 onto the flat side 44 of the boss 32 and riding there along until the detent carrier 10 snaps up firmly behind the large area latching shoulder provided by the side 36 of the boss 32, so that the content is secured against withdrawal from the housing even in the event that a substantial axial pulling force is exerted on the lead L. The advance of the contact into the housing is limited by the stops 52, the receptacle portion 1 of the contact being guided by the ribs 49. The spacing between the side 36 and the stops 52 is such that there is some axial play between the contact and the housing.

When the tab T which has been inserted into the receptacle portion 1 to an extent limited by the stop 9' through the tab insertion end 30 of the housing, is to be withdrawn, the housing is retracted relative to the contact so that the extremity 14 of the tongue 12 is depressed towards the base 5 by the ramp 42 to lift the spur 15 from the hole H in the tab T.

Since the ribs 49 extend up to the end 30 of the housing they also serve to guide the tab T into the receptacle portion 1. This feature is of particular advantage where the leading end of the tab T is burred, as will often be the case.

What is claimed is:

1. A moulded, one-piece, open ended tubular insulating housing of substantially rectangular cross-section, for a female electrical contact, the housing comprising upper and lower walls connected by first and second side walls, and having a first, contact insertion end and a second, electrical tab insertion end, a latching boss formed integrally with the inner surface of the upper wall at a position spaced from the second end of the housing but being nearer to the second end of the housing than to the first end thereof, providing a first ramp tapering towards the first end of the housing and a latching shoulder facing the second end of the housing, a second ramp formed integrally with the lower wall of the housing opposite to the first ramp, being directed towards the first end of the housing, the latching boss being shaped as a right angle triangle, and being nearer to the first side wall than to the second, the latching boss having a flat summit, which is also shaped as a right angle triangle, which summit faces toward said lower wall and is parallel to the upper wall of the housing, the first ramp and the latching shoulder immediately adjoining the flat summit, the first ramp projecting therebeyond towards the first end of the housing.

2. A housing according to claim 1, in which the lower wall is formed with a pair of parallel guide ribs extending longitudinally of the housing, and up to the second end thereof.

3. A moulded, one-piece, open ended tubular insulating housing of substantially rectangular cross-section, in combination with a female electrical contact comprising a tab receptacle portion and a wire lead connecting portion, the receptacle portion including a base and first and second side plates upstanding from opposite sides of the base, the side plates having respective first and second extensions projecting from their edges remote from the base inwardly towards the base to provide in cooperation therewith, a tab socket, the first extension having a tab retention spur, and terminating in a tongue projecting through a hole in the base, a detent support projecting from the edge of first side plate, remote from the base, between the first extension and the connecting portion, bearing a cantilever detent projecting obliquely towards the first extension at a position nearer to the first side plate than to the second side plate, the housing comprising upper and lower walls connected by first and second side walls, and having a first, contact insertion end and a second, electrical tab insertion end, a latching boss formed integrally with the inner surface of the upper wall at a position spaced from the second end of the housing but being nearer to the second end of the housing than to the first end thereof, providing a first ramp tapering towards the first end of the housing and a flat latching shoulder facing the second end of the housing, a second ramp formed integrally with the lower wall of the housing opposite to the first ramp, being directed towards the first end of the housing, the latching boss being shaped as a right angle triangle and being nearer to the first side wall than to the second, the latching boss having a flat summit, which is also shaped as a right angle triangle, which summit faces towards said lower wall and is parallel to the upper wall of the housing, the first ramp and the latching shoulder immediately adjoining the flat summit the first ramp projecting therebeyond towards the first end of the housing; whereby upon insertion of the female contact into the housing through its insertion end, the detent support is bent down about its junction with the first side plate by engagement of the detent with the first ramp and the detent is then guided by the first ramp onto the flat summit and the detent support snaps firmly behind the latching shoulder securely to retain the contact in the housing.

* * * * *